US011466533B2

(12) United States Patent
Christensen et al.

(10) Patent No.: US 11,466,533 B2
(45) Date of Patent: Oct. 11, 2022

(54) STABBING MANIFOLD AND A CONNECTION DEVICE FOR USE IN MANAGED PRESSURE DRILLING

(71) Applicant: FUTURE PRODUCTION AS, Kristiansand (NO)

(72) Inventors: Øystein Christensen, Kristiansand (NO); Edvin Andersen, Sogne (NO)

(73) Assignee: FUTURE PRODUCTION AS, Kristiansand (NO)

( * ) Notice: Subject to any disclaimer, the term of this patent is extended or adjusted under 35 U.S.C. 154(b) by 0 days.

(21) Appl. No.: 17/422,521

(22) PCT Filed: Feb. 21, 2020

(86) PCT No.: PCT/NO2020/050046
§ 371 (c)(1),
(2) Date: Jul. 13, 2021

(87) PCT Pub. No.: WO2020/171717
PCT Pub. Date: Aug. 27, 2020

(65) Prior Publication Data

US 2022/0098950 A1 Mar. 31, 2022

(30) Foreign Application Priority Data

Feb. 22, 2019 (NO) ..... 20190243

(51) Int. Cl.
*E21B 17/02* (2006.01)
*E21B 21/00* (2006.01)
(Continued)

(52) U.S. Cl.
CPC ..... *E21B 33/0387* (2020.05); *E21B 17/02* (2013.01); *E21B 21/001* (2013.01); *E21B 33/038* (2013.01)

(58) Field of Classification Search
CPC ..... E21B 17/02; E21B 21/001; E21B 33/038; E21B 33/0387
See application file for complete search history.

(56) References Cited

U.S. PATENT DOCUMENTS 4,668,126 A * 5/1987 Burton ..... E21B 19/002 166/341
8,267,179 B2 * 9/2012 Butcher ..... F16L 1/26 166/341
(Continued)

FOREIGN PATENT DOCUMENTS

EP 2499327 9/2012
GB 2486900 7/2012
(Continued)

OTHER PUBLICATIONS

Norwegian Search Report for NO 20190243, dated Sep. 20, 2019.
International Search Report and the Written Opinion for PCT/NO2020/050046, dated May 15, 2020.

*Primary Examiner* — Matthew R Buck
(74) *Attorney, Agent, or Firm* — Andrus Intellectual Property Law, LLP

(57) ABSTRACT

A connection device has a first connection body and a second connection body movable with respect to the first connection body. The connection device is configured for connecting a plurality of control lines terminating in connectors forming part of the first connection body, to corresponding control lines terminating in connectors forming part of the second connection body. The connection device is provided with a first alignment means for rough alignment of the connection bodies. The connection device further has a second alignment means for aligning the rigid holding means of one of the bodies with respect to the connectors of the other one of the bodies, at least one of the rigid holding
(Continued)

means movable in a plane perpendicular to a longitudinal axis of the first alignment means.

15 Claims, 10 Drawing Sheets

(51) Int. Cl.
*E21B 33/038* (2006.01)
*E21B 33/035* (2006.01)

(56) References Cited

U.S. PATENT DOCUMENTS

| | | | | |
|---|---|---|---|---|
| 8,403,065 | B2 * | 3/2013 | Taylor | E21B 17/046 166/356 |
| 8,875,793 | B2 * | 11/2014 | Christensen | E21B 19/004 166/345 |
| 9,175,525 | B2 * | 11/2015 | Faye | E21B 17/02 |
| 9,702,205 | B2 * | 7/2017 | Jansen | E21B 19/002 |
| 9,719,310 | B2 * | 8/2017 | MacGregor | E21B 17/015 |
| 2011/0101682 | A1 * | 5/2011 | Vatne | E21B 17/02 285/308 |
| 2012/0168168 | A1 | 7/2012 | Cruden | |
| 2018/0073320 | A1 | 3/2018 | Holmes et al. | |
| 2020/0270953 | A1 * | 8/2020 | Ziegler | E21B 17/021 |
| 2020/0270955 | A1 * | 8/2020 | Ziegler | E21B 19/004 |

FOREIGN PATENT DOCUMENTS

| | | |
|---|---|---|
| WO | 2008145168 | 12/2008 |
| WO | 2014171974 | 10/2014 |

* cited by examiner

STABBING MANIFOLD AND A CONNECTION DEVICE FOR USE IN MANAGED PRESSURE DRILLING

CROSS-REFERENCE TO RELATED APPLICATIONS

This application is the U.S. national stage application of International Application PCT/NO2020/050046, filed Feb. 21, 2020, which international application was published on Aug. 27, 2020, as International Publication WO 2020/171717 in the English language. The International Application claims priority of Norwegian Patent Application No. 20190243, filed Feb. 22, 2019. The international application and Norwegian application are both incorporated herein by reference, in entirety.

FIELD

The present invention is related to a stabbing manifold and a connection device comprising the stabbing manifold. More particularly the present invention is related to a stabbing manifold, and a connection device comprising the stabbing manifold for use in a system for Managed Pressure Drilling, MPD.

BACKGROUND

The present invention is for use in so-called Managed Pressure Drilling, MPD, when drilling exploration or productions wells in the petroleum industry. An MPD provides a closed-loop circulation system in which pore pressure, formation fracture pressure, and bottomhole pressure are balanced and managed at surface. The MPD is an adaptive drilling process that allows greater control of the annular pressure profile throughout a wellbore.

An MPD drilling system comprises a flow spool with control means such as valves, actuators, control lines such as for example hydraulic tubing and electric wiring, temperature sensors and pressure transducers.

In prior art MPD systems, there is a need for manually connecting various items of the system, such as hoses for mud return, and control means. This operation is typically performed by special trained personnel using rope access techniques to access the MPD system above a so-called moonpool of a floating drilling vessel. The skilled person will appreciate that, in addition of being very time-consuming, typically up to 48 hours, such a manual work is encumbered with a relatively high risk of personnel injuries.

European patent specification EP 2 499 327 B1 to the present applicant, discloses a connecting device for so-called kill- and choke lines between a riser and a floating drilling platform. The connecting device comprises a slip joint on top of said riser comprising an outer barrel, a kill- and choke manifold arranged on said platform and provided with flexible kill- and choke hoses to an outer barrel of said slip joint. The characteristic features of the connecting device is that said outer barrel of the slip joint is provided with a horizontally directed kill- and choke manifold with horizontally directed pipe ends, and said kill- and choke hoses are provided with a kill- and choke connector manifold with horizontally directed receptacles arranged for receiving said horizontally directed pipe ends, wherein said kill- and choke connector manifold is arranged on a manipulator arm extending from a structure of said drilling platform, and arranged for being moved generally in a horizontal direction for connecting said connector manifold to said manifold.

In EP 2 499 327 B1, the connector manifold is provided with guide pins and the kill- and choke manifold is provided with corresponding guide sleeves configured for roughly guiding the connection between the connector manifold and the kill- and choke.

The applicant has found that features of the prior art system disclosed in EP 2 499 327 B1 may be used also in a system for MPD (Managed Pressure Drilling). Such features include for example the way of aligning the connection bodies, and a manipulator used to handle one of the bodies and releasably interlocking the connection bodies.

However, a connecting device for kill- and choke lines between a riser and a floating drilling platform disclosed in EP 2 499 327 B1 is far less complicated than an MPD system which requires connection of plurality of control lines, such as for example but not limited to, hydraulic lines and electric wiring, for operating the flow spool of the MPD system.

Publication US 2012/168168 A1 discloses a method of forming a subsea lead connection. A free portion of a stab plate connection system is moved into proximity with a fixed portion of the stab plate connection system at a subsea location. The free portion is initially engaged with the fixed portion via a docking probe. Subsequently, a local actuator is used to draw the free portion into an operating engagement with the fixed portion in which line couplers of the fixed portion are engaged with corresponding line couplers of the free portion.

Publication GB 2486900 A discloses a subsea connection assembly comprises a stab plate assembly comprising a first stab plate which carries a plurality of couplers for cooperating with respective couplers on a complementary plate. The assembly includes a mount, a support which is disposed for lateral movement in at least one direction relative to the mount, and a pivot which allows tilting movement of the stab plate relative to the support.

Publication WO 2014/171974 A1 discloses a connection system for connecting a structure fluid line on an offshore structure with a riser fluid line on a subsea riser. The system includes a connector attachable to the subsea riser and a gooseneck comprising a gooseneck connector in fluid communication with the structure fluid line. A frame is supportable on the connector and comprises a slide releasably engageable with the gooseneck and moveable within the frame. The slide is remotely controllable to move the gooseneck connector into and out of a connected position to establish or break fluid communication between the structure fluid line and the riser fluid line.

WO 2008/145168 A1 discloses a multicoupler for subsea gas or oil production, comprising at least one male and one female part, each of said parts comprising a plurality of fluid coupling members which can be assigned to one another and which are in engagement with one another when male part and female part are in the coupling position, one part comprising a connecting means including a spindle, which connecting means in the coupling position is in engagement with a mating connecting means on the other part. The connecting means comprises a threaded section rotatable by said spindle and the mating connecting means comprising a mating threaded section and a free-rotating chamber, the threaded section being helically movable along the mating threaded section up into the free-rotating chamber while occupying the coupling position.

Connectors for control lines, in particular connectors for electric wiring comprising contact pins, but also optical fibres and hydraulic and/or pneumatic lines, may be vulnerable for damage and subsequent malfunction.

SUMMARY

The invention has for its object to remedy or to reduce at least one of the drawbacks of the prior art, or at least provide a useful alternative to prior art.

The object is achieved through features, which are specified in the description below and in the claims that follow.

In accordance with a first aspect of the invention, there is provided a stabbing manifold for use in a system for Managed Pressure Drilling, the stabbing manifold configured for connecting to a riser manifold, the stabbing manifold being movable with respect to the riser manifold, the stabbing manifold comprising a plurality of control lines terminating in connectors configured for connecting to a plurality of connectors forming terminations of control lines of the riser manifold, the stabbing manifold provided with a first alignment means configured for rough alignment with alignment means of the riser manifold, wherein the connectors of the stabbing manifold are secured to a rigid holding means forming part of the stabbing manifold, the rigid holding means is configured for a limited movement with respect to the stabbing manifold, the stabbing manifold further comprising a second alignment means forming part of the rigid holding means and configured for aligning with the rigid holding means of the riser manifold, wherein the rigid holding means of the stabbing manifold movable in a plane perpendicular to a longitudinal axis of the first alignment means, wherein the stabbing manifold comprises a fluid channel configured for connection to a fluid channel of the riser manifold, the fluid channel configured for communicating a well control fluid.

The first alignment means for rough alignment of the stabbing manifold, may be similar to pins disclosed in EP 2 499 327 B1.

The effect of securing connectors to a rigid holding means configured for a limited movement with respect to the stabbing manifold, is that after being roughly aligned by the first alignment means, the second alignment means may, in a position of use, align the rigid holding means and thus all the connectors secured thereto, into alignment with connectors of opposing connectors of a riser manifold.

The connectors of the stabbing manifold may in one embodiment be configured for a limited individual movement. By allowing a limited individual movement of the connection bodies, any tolerance deviation with respect to an arrangement of the individual connectors may be remedied.

By the term "limited movement" is meant a movement up to for example ±3 mm in an X-Y direction of a plane being perpendicular to the longitudinal axis of the first alignment means.

In an alternative embodiment, the stabbing manifold may be provided with the rigid holding means, wherein the rigid holding means is configured for preventing individual movement of the connectors.

The control lines may be selected from the group consisting of one of or a combination of two or more of electrical lines, hydraulic lines, pneumatic lines and fiber optic lines.

The well control fluid may be a drilling mud for use in Managed Pressure Drilling, MPD.

The stabbing manifold may be configured for carrying mud return conduits.

The stabbing manifold may further be provided with one umbilical connection for receiving an umbilical comprising control lines configured for communicating with the control lines of the stabbing manifold when the umbilical is connected to the stabbing manifold.

In accordance with a second aspect of the invention, there is provided a connection device for use in a system for Managed Pressure Drilling, MPD, the connection device comprising a riser manifold and a stabbing manifold movable with respect to the riser manifold, the connection device configured for connecting a plurality of control lines terminating in connectors forming part of the riser manifold, to corresponding control lines terminating in connectors forming part of the stabbing manifold, the connection device provided with a first alignment means for rough alignment of the riser manifold and stabbing manifold with respect to each other, wherein the connectors of the riser manifold are secured to rigid holding means forming part of the riser manifold, and the connectors of the stabbing manifold are secured to a rigid holding means forming part of the stabbing manifold, at least one of the rigid holding means is configured for a limited movement with respect to its respective manifold, the connection device further comprising a second alignment means forming part of the rigid holding means and configured for aligning the rigid holding means with respect to each other, wherein at least one of the rigid holding means movable in a plane perpendicular to a longitudinal axis of the first alignment means. The riser manifold comprises a fluid channel for connection to a fluid channel of the stabbing manifold, the fluid channels configured for communicating a well control fluid.

The first alignment means for rough alignment of the connection bodies, may be similar to pins and guiding sleeves disclosed in EP 2 499 327 B1.

The effect of securing connectors to a rigid holding means configured for a limited movement with respect to its manifold, is that after being roughly aligned by the first alignment means, the second alignment means aligns the rigid holding means and thus all the connectors secured thereto, into alignment with the connectors of the opposing manifold.

By the term "limited movement" is meant a movement up to for example ±3 mm in an X-Y direction of a plane being perpendicular to the longitudinal axis of the first alignment means. Thus, the rough alignment provided by the first alignment means should be capable of aligning the connection bodies within said limited movement prior to the alignment by the second alignment means commences.

The connectors of at least one of the riser manifold and stabbing manifold may be configured for a limited individual movement. By allowing a limited individual movement of the connection bodies, any tolerance deviation with respect to an arrangement of the individual connectors may be remedied.

In one embodiment of the present invention, one of the riser manifold and stabbing manifold is provided with the rigid holding means, the rigid holding means configured for preventing individual movement of the connectors, and the connectors of the other one of the stabbing manifold and riser manifold are configured for the limited individual movement.

The control lines may be selected from the group consisting of one of or a combination of two or more of electrical lines, hydraulic lines, pneumatic lines and fiber optic lines. Thus, the connectors may be couplings and/or pipe nipples/receptacles.

As mentioned above, the riser manifold comprises a fluid channel for connection to a fluid channel of the stabbing manifold. The fluid channels are configured for communicating a well control fluid when the riser manifold and the stabbing manifold have been connected. The well control fluid is a drilling fluid for use in Managed Pressure Drilling, MPD. Preferably, the interconnecting portions of the fluid channels run substantially horizontally. From the disclosure below, it should be appreciated that the fluid channels of each of the riser manifold and the stabbing manifold may comprise a bend, typically 90°, between the inlet portion and the outlet portion of the fluid channel. That is, a longitudinal axis of the inlet portion of the fluid channel runs typically 90° with respect to a longitudinal axis of the outlet portion of the fluid channel.

The skilled person will appreciate that MPD requires a flow spool. The riser manifold may form part of a flow spool configured for use in Managed Pressure Drilling, wherein the control lines of the riser manifold are operatively connected to flow spool control means. The flow spool control means may for example be valves and valve actuators for controlling the mud flow.

The stabbing manifold may be configured for carrying mud return hoses for connection to the flow spool via the riser manifold. The mud return hoses provide fluid communication with equipment on the rig, as will be appreciated by a person skilled in the art.

From the above, it should be clear that the fluid channels and the control lines of the riser manifold and the stabbing manifold may be connected substantially simultaneously. This has the effect that the connection device may connect mud lines and control lines required for controlling the flow spool in a single, remotely controlled operation.

In one embodiment, the stabbing manifold may be further provided with one umbilical connection for receiving an umbilical comprising control lines configured for communicating with the control lines of the stabbing manifold when the umbilical is connected to the stabbing manifold. Thus, the flow spool control means may be controlled via an umbilical from for example a drilling rig.

The skilled person will appreciate that mud lines in an MPD flow spool, will be subject to wear and other factors such as incrustation on the internal wall thereof. A bend in a mud line will be particularly vulnerable to wear. In order to facilitate any maintenance work of the fluid channel, the riser manifold may comprise a housing and a fluid channel receptacle block releasably secured to the housing. When forming part of an MPD flow spool, the housing is configured for being secured thereto. Thus, the fluid channel receptacle block may be removed from the MPD flow spool while the housing remains in place. A time-consuming complete dismantling of the riser manifold from the flow spool is therefore avoided when any maintenance or replacement of the fluid channels is required.

The fluid channel receptacle block may be secured to the housing by means of fastening means for providing a clearance between the fluid channel receptacle block and the housing when in a position of use.

By providing a clearance between the fluid channel receptacle block and the housing, any undesired "interlocking" between the receptacle block and the housing due to for example corrosion, will be substantially eliminated.

The fastening means may be in the form of bolts and mating guiding sleeves.

In one embodiment, the fluid channel receptacle block may be provided with at least one clearance hole running through the block from a face thereof, the clearance hole provided with a threaded portion configured for receiving a pulling bolt.

The pulling bolt may have an axial length exceeding an axial length of the clearance hole.

This has the effect that the pulling bolt upon rotation may abut a surface of the housing beyond an end portion of the clearance hole and thereby displace the receptacle block with respect to the housing.

In a third aspect of the invention, there is provided a flow manifold comprising: a housing; and a fluid channel receptacle block releasably secured to the housing and having at least one fluid flow channel therethrough.

The fluid channel receptacle block may be secured to the housing by means of fastening means configured for providing a clearance between the fluid channel receptacle block and the housing when in a position of use The fastening means may be in the form of bolts and mating guiding sleeves.

The fluid channel receptacle block may further be provided with at least one clearance hole running through the block from a face thereof. The clearance hole may be provided with a threaded portion configured for receiving a pulling bolt.

The pulling bolt may have an axial length exceeding an axial length of the clearance hole so that the clearance bolt upon rotation may abut a surface beyond an end portion of the clearance hole and thereby displace the receptacle block with respect to the housing.

The flow manifold may be further provided with features as disclosed in the first aspect of the invention.

In accordance with a fourth aspect of the invention, there is provided a male connection body configured for moving into or out of engagement with a mating female connection body, the male connection body comprising a plurality of control lines terminating in connectors, the male connection body provided with a first alignment means protruding from a face portion thereof. The connectors are secured to a rigid holding means configured for a limited movement with respect to the male connection body, the male connection body further comprising a second alignment means secured to and protruding from the rigid holding means of the male connection body, the rigid holding means movable in a plane perpendicular to a longitudinal axis of the first alignment means.

The control lines may be selected from the group consisting of one of or a combination of two or more of electrical lines, hydraulic lines, pneumatic lines and fiber optic lines.

In one embodiment, the connectors are configured for a limited individual movement. In an alternative embodiment, the connectors are fixed with respect to the rigid holding means so that the connectors are prevented from individual movement. In still another embodiment at least one of the connectors are configured for a limited individual movement and at least one of the connectors are prevented from movement with respect to the rigid holding means.

The male connection body may be provided with a fluid channel configured for communicating a well control fluid. The well control fluid may be a drilling fluid for use in Managed Pressure Drilling, so-called MPD.

The male connection body may be configured for carrying mud return conduits. The male connection body may be provided with one umbilical connection for receiving an umbilical comprising control lines configured for communicating with the control lines of the male connection body when the umbilical is connected to the male connection body.

The male connection body is configured for being connected to a manipulator configured for moving the male connection body.

The male connection body may be the stabbing manifold according to the first aspect of the invention.

DETAILED DESCRIPTION OF THE DRAWINGS

Figure 1A:
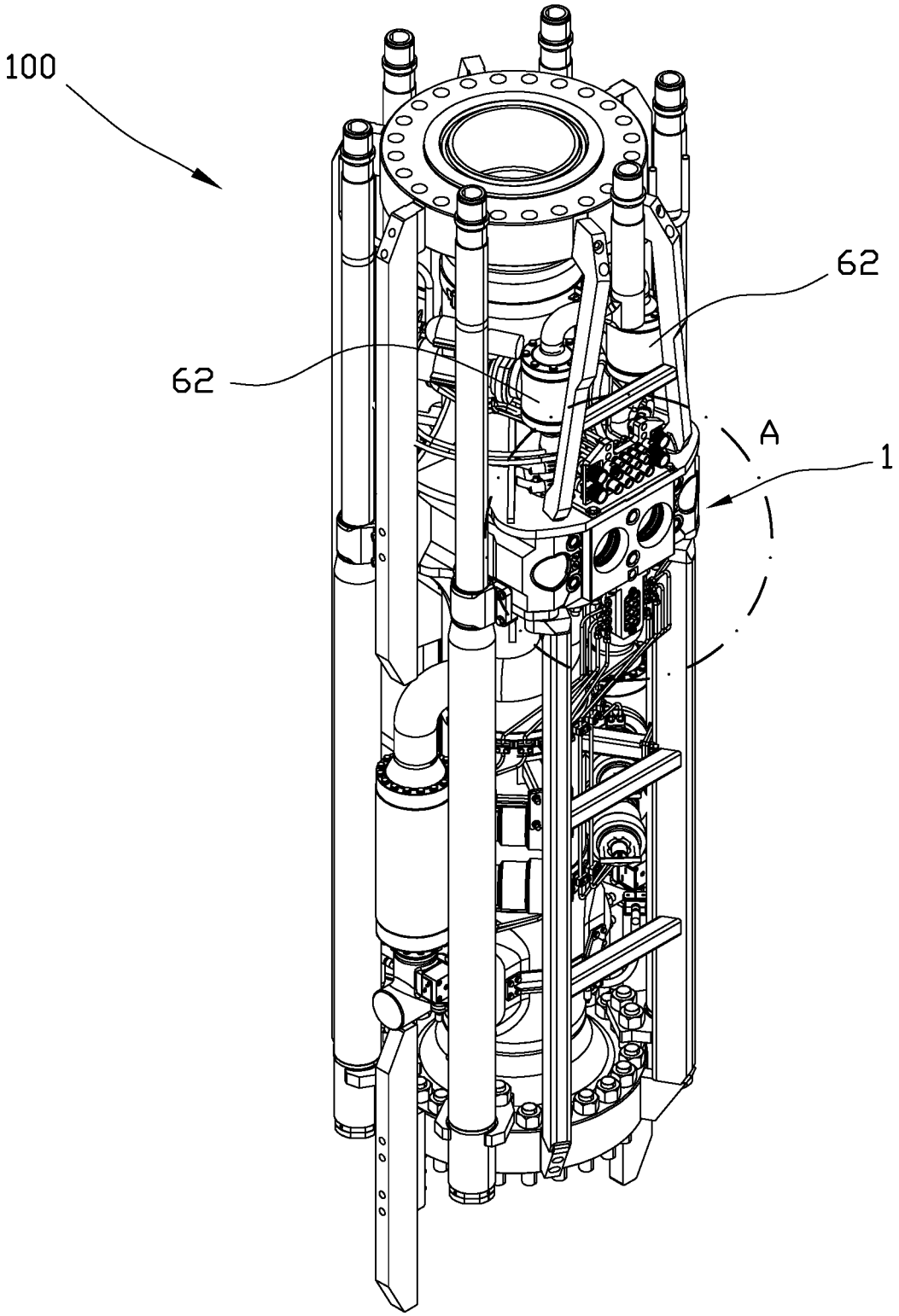
FIG. 1*a* illustrates a riser manifold integrated in a riser flow spool.

Positional specifications such as upward, downward, down, top, bottom, etc. refer to the positions shown in the figures.

In the figures, the same reference numerals indicate the same or corresponding elements. Not all elements are indicated by reference numerals in all the figures.

In the figures, reference numeral 1 denotes a riser manifold configured for mating with a stabbing manifold 20 movable with respect to the riser manifold 1. The riser manifold 1 will hereinafter also be denoted a female connection body 1, and the stabbing manifold 20 will also be denoted a male connection body 20.

Figure 3A:
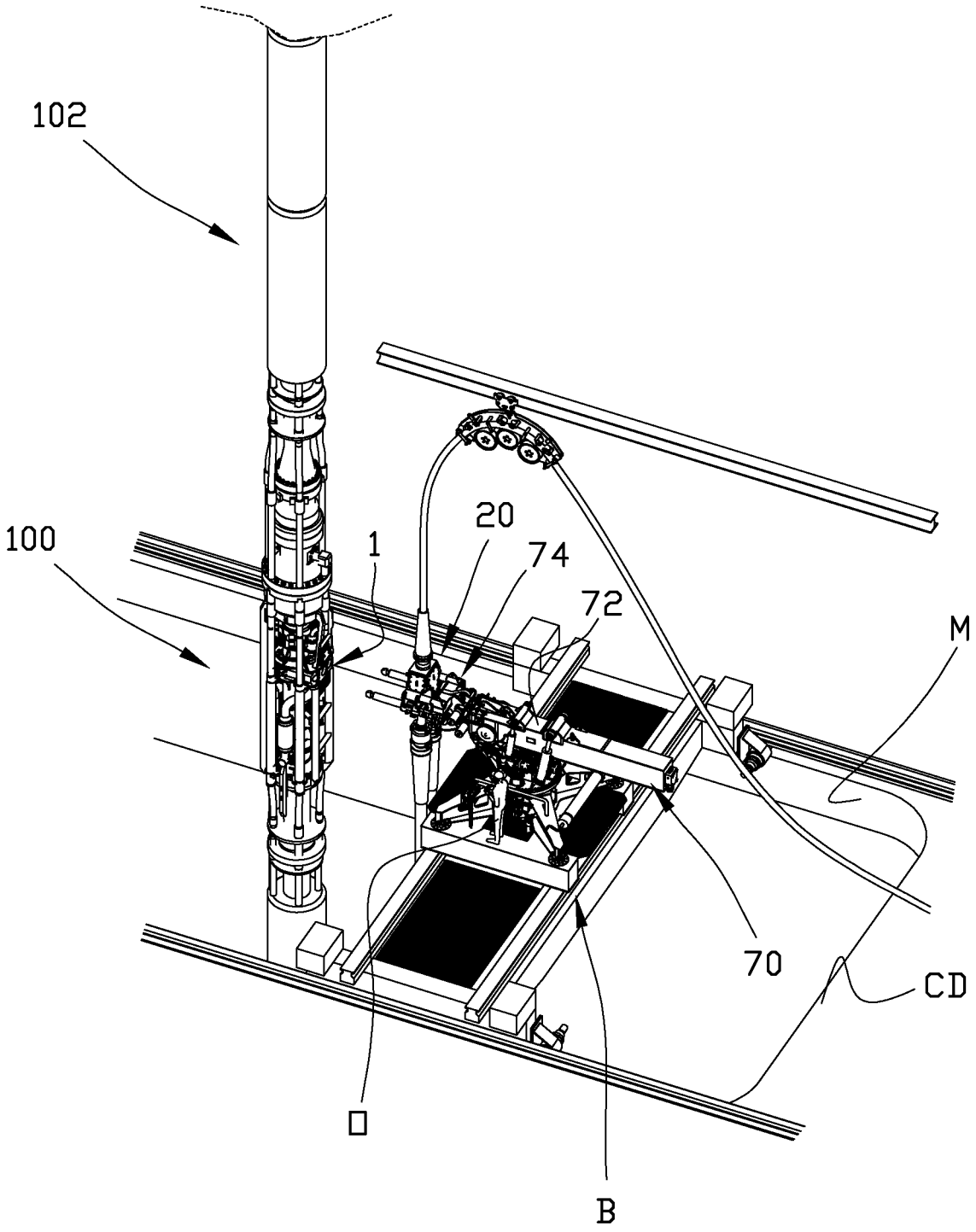
FIGS. 3*a*-3*c* illustrate a sequence of moving the stabbing manifold into engagement with a riser manifold.
Figure 3B:
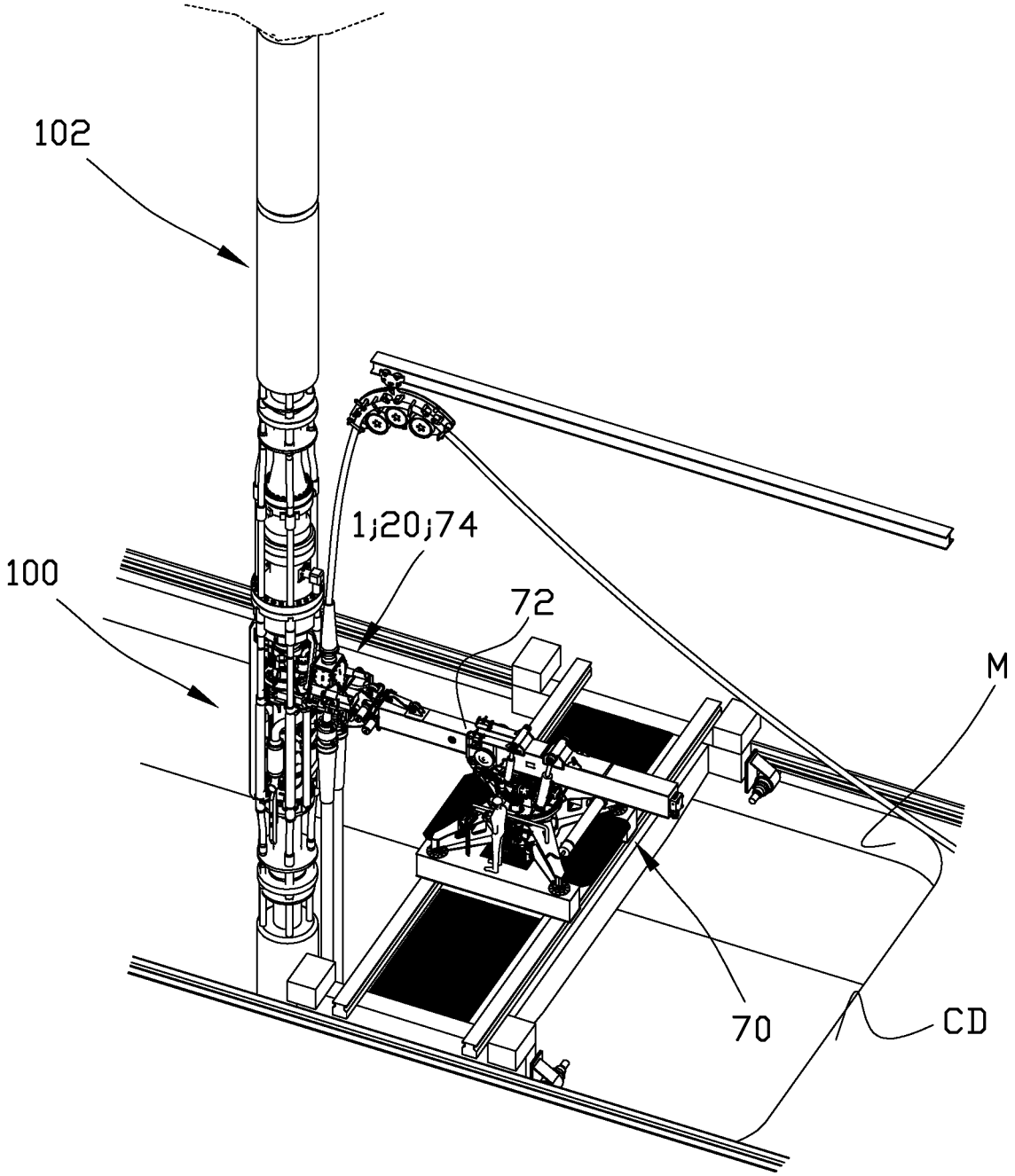
Figure 3C:
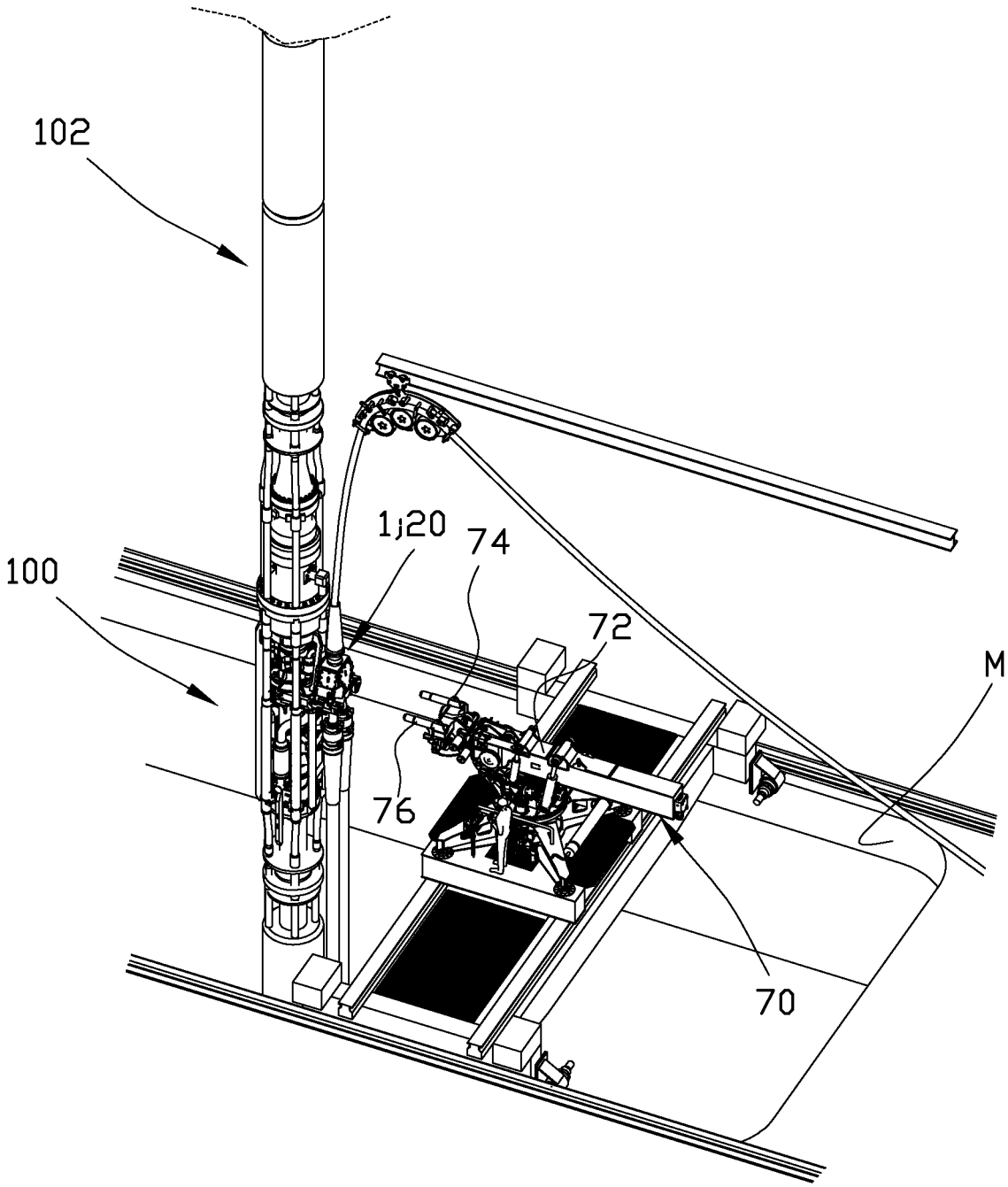

In the embodiment shown, the riser manifold 1 is integrated in a flow spool 100 as best seen in FIG. 1*a*. The flow spool 100 forms part of a riser 102 as illustrated in FIG. 3*a*-3*c*.

Figure 1B:
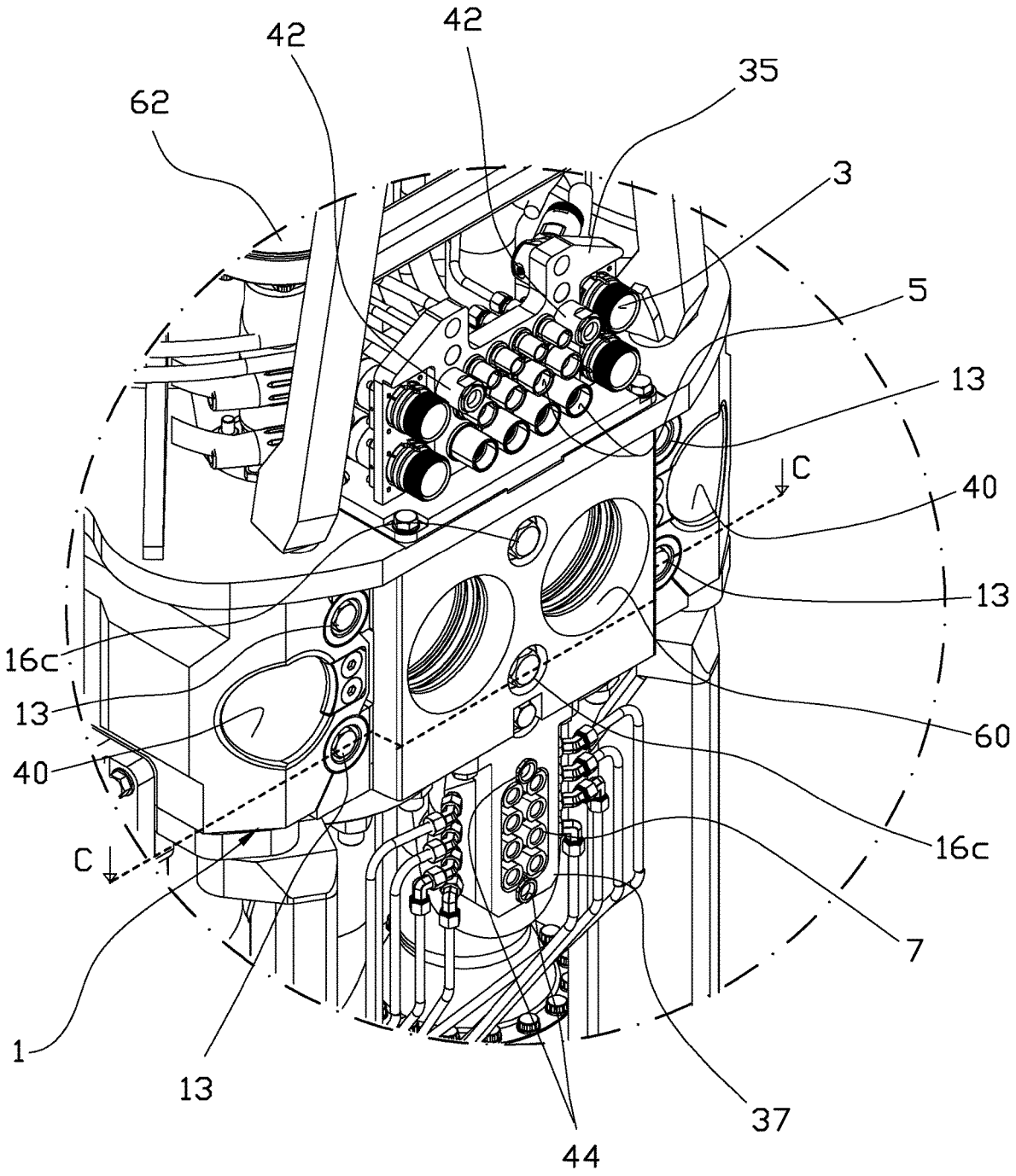
FIG. 1*b* illustrates in larger scale detail A in FIG. 1*a;*

As best seen in FIG. 1*b*, the riser manifold 1 comprises several connectors 3, 5 for control lines. The control lines may for example be electric, hydraulic, pneumatic or optical lines. The connectors 3, 5 are secured to a rigid holding means 35, here in the form of a plate 35 secured to and protruding upwardly from a top portion of the riser manifold 1. The connectors 3, 5 extend through apertures in the plate 35. Preferably, the apertures have a diameter being larger than a diameter of the respective connector 3, 5 at the portion passing the aperture, so that each connector 3, 5 is allowed to move or "float" with respect to the plate 35. A perimeter of the connectors 3, 5 abut opposing faces of the plate 35 so that connectors are substantially prevented from moving axially with respect to the plate 35.

In the embodiment shown, the riser manifold 1 further comprises connectors 7 secured to a rigid holding means in the form of a plate 37 protruding downwardly from and secured to a bottom portion of the riser manifold 1. The individual connector 7 may float with respect to the plate 37 as discussed above.

Figure 2A:
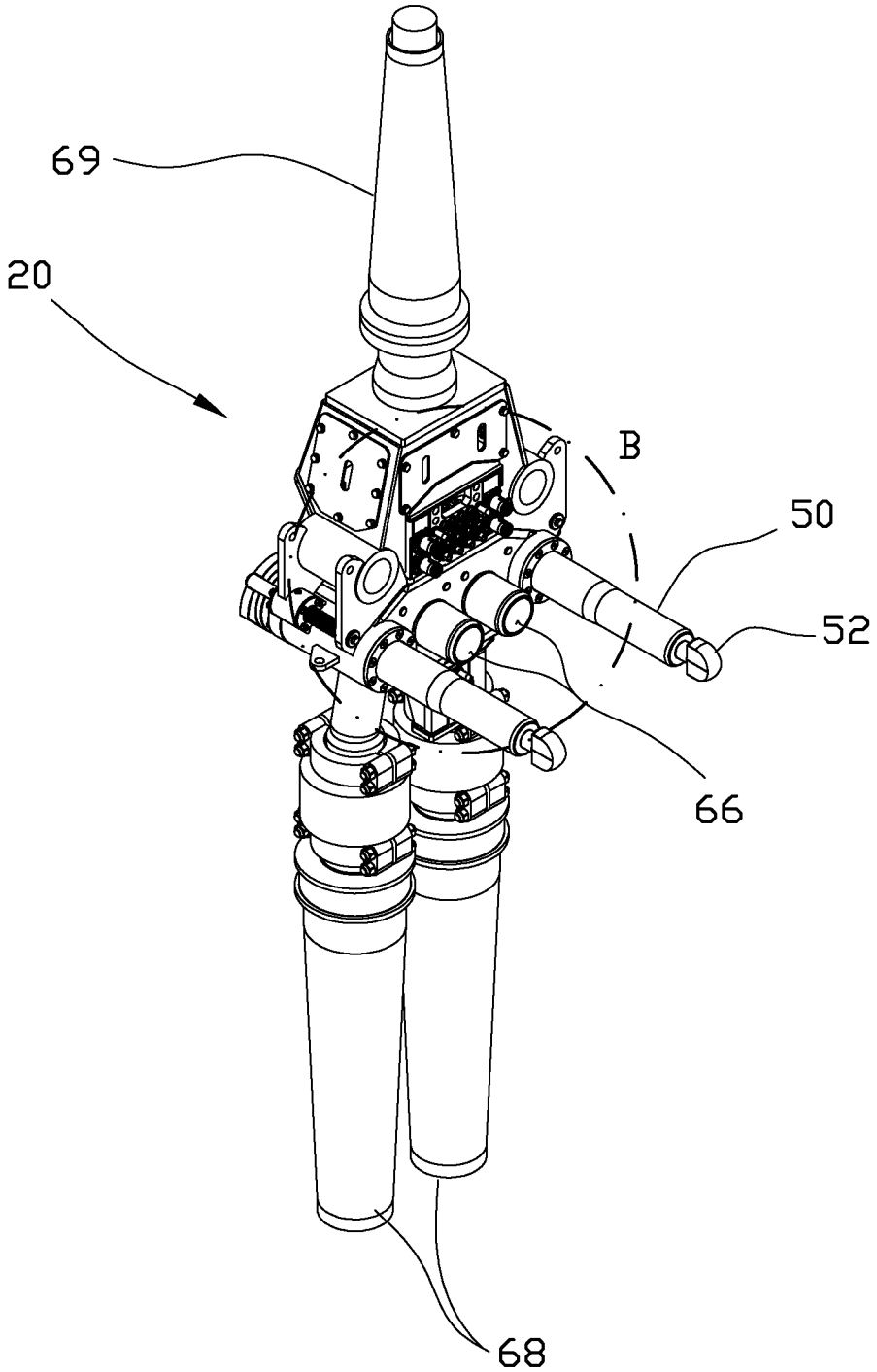
FIG. 2*a* illustrates a stabbing manifold viewed in perspective from a front.
Figure 2B:
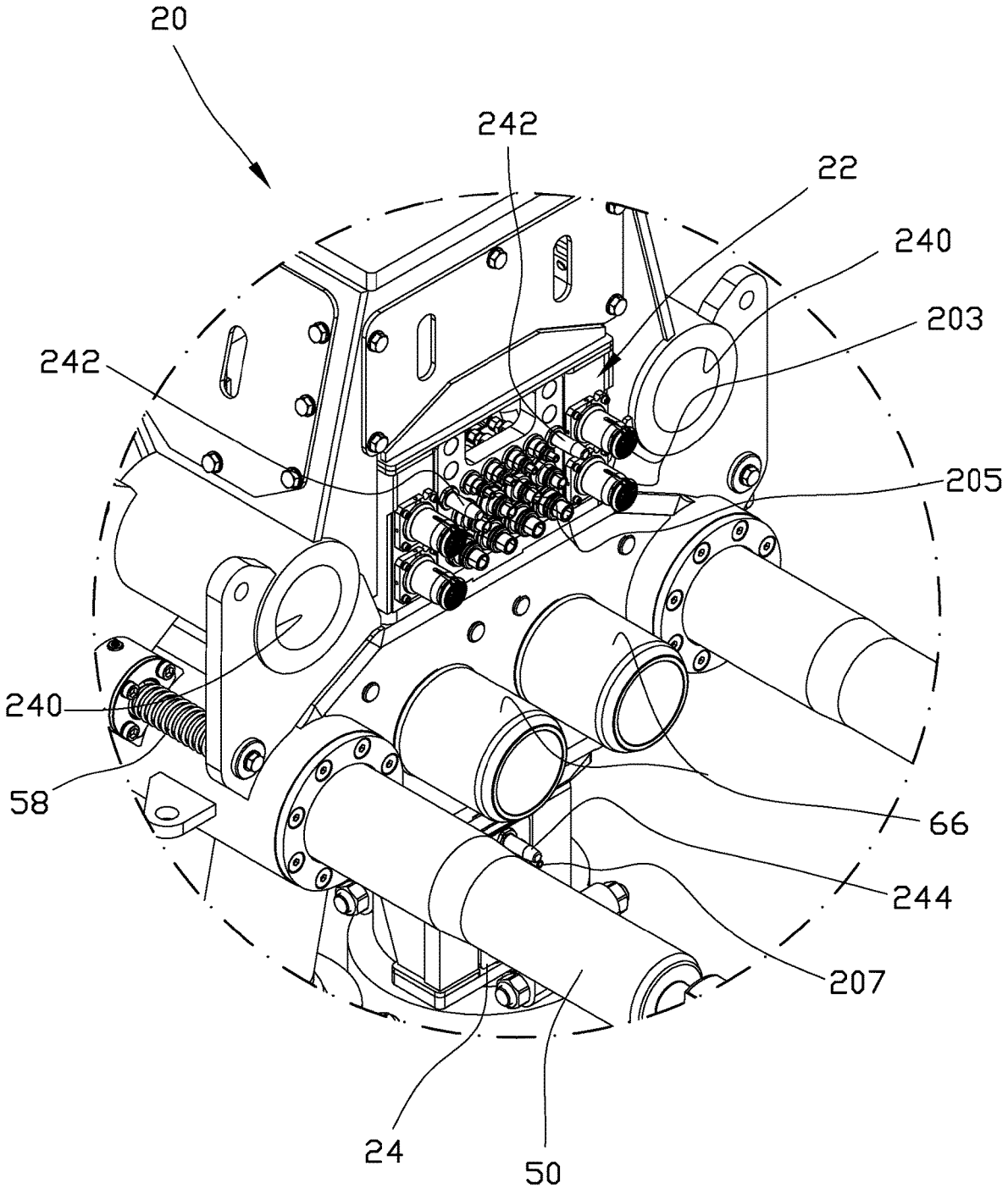
FIG. 2*b* illustrates in larger scale detail B in FIG. 2*a;*
Figure 2C:
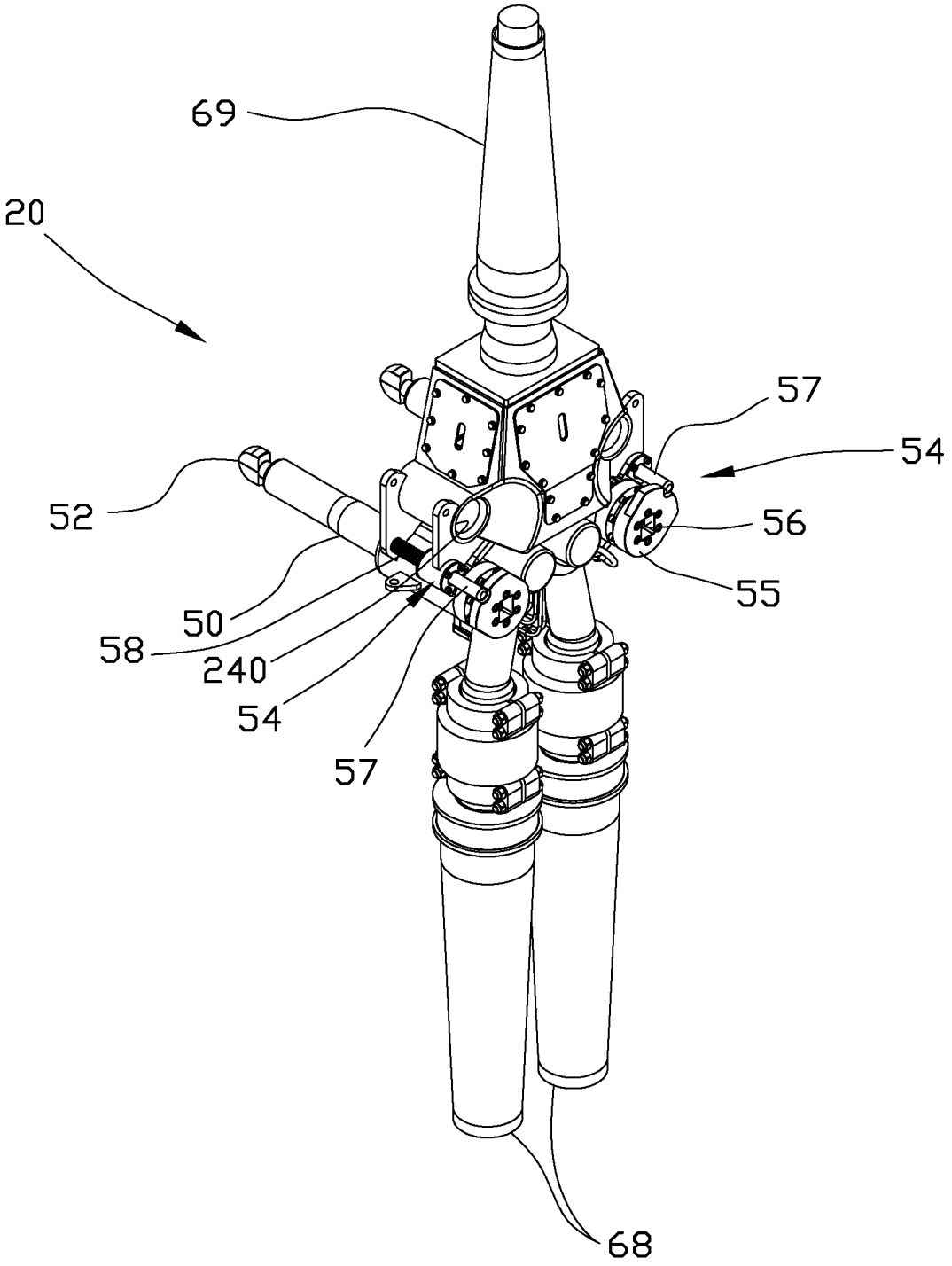
FIG. 2*c* illustrates the stabbing manifold in FIG. 2*a* viewed in perspective from a back.

The riser manifold 1 further comprises first alignment means 40, here in the form of two guide sleeves 40 configured for receiving alignment means in the form of guide-posts 50 protruding from a face of the stabbing manifold 20 (the male connection body) as best seen in FIGS. 2*a*, 2*b* and 2*c*.

The stabbing manifold 20 is configured to be moved into engagement with the riser manifold 1 by means of a manipulator 70 shown in FIGS. 3*a*-3*c*.

As best seen in FIG. 2*b*, the stabbing manifold 20 comprises connectors 203, 205 for mating with the connectors 3, 5 of the riser manifold 1, and connectors 207 (only one partly visible in FIG. 2*b*) for mating with the connectors 7 of the riser manifold 1.

The connectors 203, 205 are secured to a rigid holding means in the form of a plate 22 secured to a body of the stabbing manifold 20. The plate 22 is configured for moving a certain distance, in one embodiment ±3 mm, sideways and up-and-down with respect to the body of the stabbing manifold 20. This "floating" features of the plate may for example be achieved by means of a tongue-and-groove-like configuration and a resilient or elastic means configured for substantially centring the plate 22 in a "neutral" position.

The connectors 207 are secured in a similar way to a rigid holding means in the form of a plate 24.

In the embodiment disclosed in the figures and discussed above, the connectors 203, 205 may be, but does not have to be, prevented from moving with respect to the plate 22. The same applies to the connectors 207 arranged in the plate 24. The connectors 203, 205 and 207 should therefore be mounted in apertures or bores in the plates 22, 24. The bores are provided mutually spaced-apart within a certain tolerance. Any position deviations between individual bores exceeding the tolerance will result in position deviations of the connectors 203, 205 and 207. However, due to the "floating" configurations of the connectors 3, 5 and 7 arranged on the plates 35 and 37, respectively, the connectors may still mate despite any such position deviations of the connectors 203, 205 and 207.

In the embodiment shown, the connectors 3, 5, 7 of the riser manifold 1 are female couplings and the connectors 203, 205, 207 of the stabbing manifold 20 are male couplings, hence the denomination female connection body 1 and male connection body 20, respectively. Obviously, the connectors 3, 5, 7 of the riser manifold 1 may alternatively be male couplings and the connectors 203, 205, 207 of the stabbing manifold 20 may be female couplings. However, the shown embodiment is preferred.

The riser manifold 1 further comprises two fluid flow channels 60. Each channel 60 has an inlet in a bottom portion of the riser manifold 1, and an outlet in a face configured for abutting a face of the stabbing manifold 20. Similarly, the stabbing manifold 20 has corresponding flow channels 66 with inlets protruding from the face of the stabbing manifold 20 and outlets in a bottom portion, as best seen in FIGS. 2*a*-2*b*. Thus, the fluid flow channels 60, 66 comprises pipe-bends within the manifolds 1, 20.

In operation, the fluid flow channels 60, 66 in the shown embodiment communicate drilling mud returned from the well to the rig. The stabbing manifold 20 carries mud return hoses 68 extending to a drilling rig as will be appreciated by a person skilled in the art.

Turning now to FIGS. 3*a*-3*c* illustrating a sequence of moving the stabbing manifold 20 into engagement with the riser manifold 1 by means of the manipulator 70.

In FIG. 3*a*, the riser 102 comprising the flow spool 100 and the riser manifold 1 has been moved vertically and aligned with respect to a moonpool M at a cellar deck CD under the rig floor, so that the stabbing manifold 20 is substantially at same elevation as the riser manifold 1 of the flow spool 100. In the embodiment shown, the stabbing manifold 20 has been picked up from a storage area (not shown) by means of the manipulator 70 which is movable on rails both in an axial and a longitudinal direction with respect to the moonpool M. An arm 72 of the manipulator 70 is pivotable with respect to its base B. The manipulator arm 72 is further pivotable with respect to a horizontal axis, and a manipulator head 74 (see FIG. 3*c*) forming an end portion of the arm 72, is pivotable a certain angle around a longitudinal axis of the arm 70. The manipulator head 74 is provided with manipulator head guideposts 76 configured for releasable engaging stabbing manifold guide sleeves 240. The manipulator head guideposts 76 are seen in FIG. 3*c*. The stabbing manifold guide sleeves 240 are shown in FIGS. 2*a*-2*c*.

The movability of the arm 72 and head 74 facilitates connection of the manifolds 1, 20 because the arm 72 and head 74 are capable of following any movement of the riser 100 prior to releasing the manipulator head 74 from the stabbing manifold 20 when this has been secured to the riser manifold 1, as shown in FIG. 3*b*.

In FIG. 3*b* the manipulator arm 72 has been telescoped towards the riser manifold 1. In FIG. 3*c* the manipulator head 74 has been released from the stabbing manifold 20 and the arm 72 has been retracted.

When the stabbing manifold 20 is moved towards the flow spool 100 and its riser manifold 1, an operator O controls the position of the guideposts 50 protruding from the stabbing manifold 20, with respect the guide sleeves 40 of the riser manifold 1.

As best seen in FIGS. 2*a*-2*c*, the guideposts 50 have a two-diameter configuration wherein a distant portion of the guideposts 50 has a first diameter and a proximate portion has a second diameter wherein the first diameter is smaller than the second diameter. Thus, the guideposts 50 first provides a rough alignment, and thereafter a finer alignment of the manifolds 1, 20. It should be noted that an axial length of said proximate portion is longer than an axial length of the flow channels 66 protruding from the face of the stabbing manifold 20 so that said finer alignment is achieved prior to mating the flow channels 60, 66.

The diameter of the proximate portion of the guideposts 50 substantially corresponds to the internal diameter of the guide sleeves 40. However, with regards to the required fine-tolerance mating of the connectors 3, 5 with the connectors 203, 205 and connectors 7 with connectors 207, the alignment provided by the guideposts 50 and sleeves 40 may not be sufficient accurate for a desired alignment, and a second alignment means are required.

In the embodiment shown, a second alignment means comprises two receptacles 42 arranged distant from each other on the plate 35. The receptacles 42 are configured for mating tapered pins or guideposts 242 protruding from the plate 22 of the stabbing manifold 20, see FIG. 2*b*.

To align the connectors 7, 207 arranged on respective plates 37, 24 protruding downwardly from the riser manifold 1 and stabbing manifolds 20, respectively, the second alignment means further comprises receptacles 44 arranged distant from each other on the plate 37, and mating tapered pins or guideposts 244 (only one visible in FIG. 2*b*) protruding from the plate 24 of the stabbing manifold 20.

The second alignment means 42, 242; 44, 244 thus provides means for eliminating any misalignment of the connection plates 35, 22; 37, 24 by urging the displaceable plates, here the plates 22, 24, into correct position. When the plates are in the correct position, the connectors should also be in the correct position. Any position deviation of an individual connector, may according to the embodiment discussed above, be compensated by means of the providing connectors being individually movable with respect to the plates 35, 37.

When the stabbing manifold 20 has been fully aligned with the riser manifold 1 and the connectors of the plurality of control lines are connected, the stabbing manifold 20 is locked to the riser manifold 1 by means of a fail-safe locking mechanism 54 as seen in FIG. 2*c*. In the embodiment shown, the locking mechanism 54 comprises cam locks 52 protruding from a distant end portion of the guideposts 50. The cam locks 52 are rotatable 90° around a longitudinal axis of the guideposts 50 and operable by means of a portion of the manipulator 70 configured for engaging a recess 56 in an engagement portion 55 of the locking mechanism 54 to lock the guideposts 50 with respect to the sleeves 40.

The fail-safe locking mechanism 54 is provided with locking pins 57 being urged by a spring 58 into engagement with an indent in the engagement portion 55 when the cam locks 52 has been rotated into the locking position. Thereby, the locking pins 57 prevents any further rotation in any direction of the engagement portion 55. When in the locking position, a rotation of the cam locks 52 is prevented. To disengage the fail-safe locking mechanism 54, the pin 57 is driven out of engagement by a disengagement means (not shown) connected to the manipulator 70.

When the riser manifold 1 forms part of a flow spool 100 as shown in FIGS. 1*a*-1*b* and FIGS. 3*a*-3*c* and discussed above, the angled flow channels 60 of the riser manifold 1 are subject to wear and other factors such as incrustation on the internal wall thereof. Maintenance of the flow channels 60 may therefore be required after some time in operation.

The skilled person will appreciate that such maintenance cannot be performed in situ. The skilled person will also appreciate that dismantling the riser manifold 1 from the flow spool 100 is practically impossible to perform in situ.

The applicant has solved the above challenges by arranging the flow channels 60 in a removable portion of the riser manifold 1.

Figure 4A:
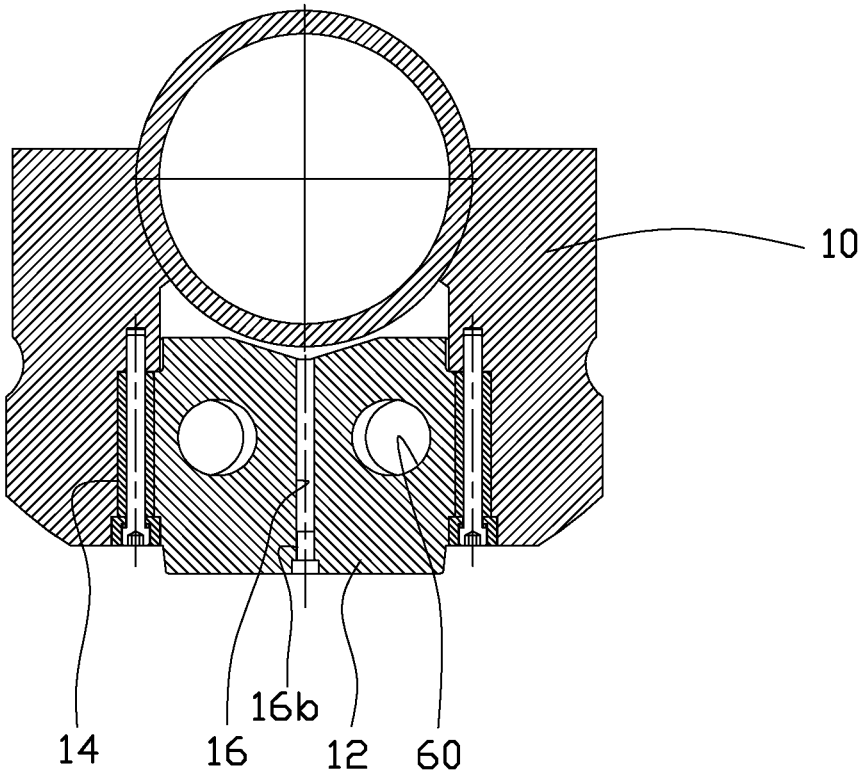
FIG. 4*a* illustrates a horizontal cross section through C-C of FIG. 1*b;*

FIG. 4*a* illustrates a horizontal cross section through C-C of the riser manifold 1 shown in FIG. 1*b*. The riser manifold 1 comprises a housing 10 and a receptacle block 12 comprising two flow channels 60. The receptacle block 12 is configured for being slid into and out of a slot 11 of the housing 10.

The receptacle block 12 is secured to the housing 10 by means of fasteners in the form of bolts 13 (four bolts shown in FIG. 1*b*) running through guiding sleeves 14. An end portion of the bolts 13 are configured for engaging a threaded slot in the housing 10, as shown.

The guiding sleeves 14 are configured for aligning the receptacle block 12 with respect to the housing 10. Further, the guiding sleeves 14 are configured for keeping a small clearance, for example in the range of 1-2 mm, between the surfaces of the receptacle block 12 facing the surfaces of the housing 10. Thereby, the guiding sleeves 14 provides reduced friction between the surfaces which represents an advantage when sliding the receptacle block 12 out of the housing 10. However, more importantly the clearance reduces the risk of "binding" the surfaces together for example due to corrosion that are likely to occur when submerged in sea water.

Figure 4B:
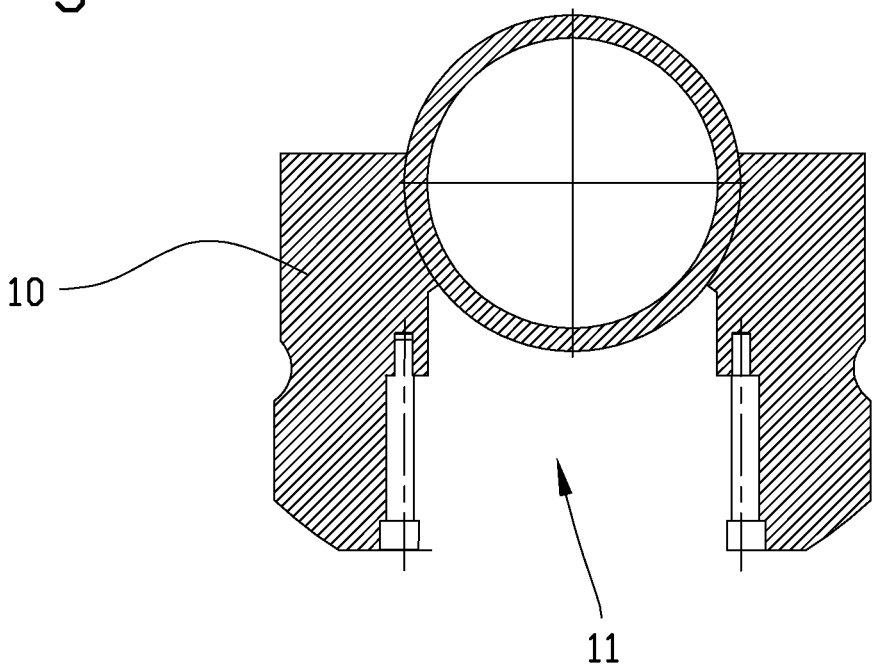
FIG. 4*b* illustrates the same as FIG. 4*a*, after a fluid channel receptacle block has been removed from a housing.

In FIG. 4*b*, the bolts 13 have been removed, and the receptacle block 12 has been removed for maintenance or replacement. It should be noted that prior to removing the receptacle block 12 from the housing 10 of the riser manifold 1, some dismantling of piping and control lines shown in FIGS. 1*a* and 1*b* have be carried out.

Figure 4C:
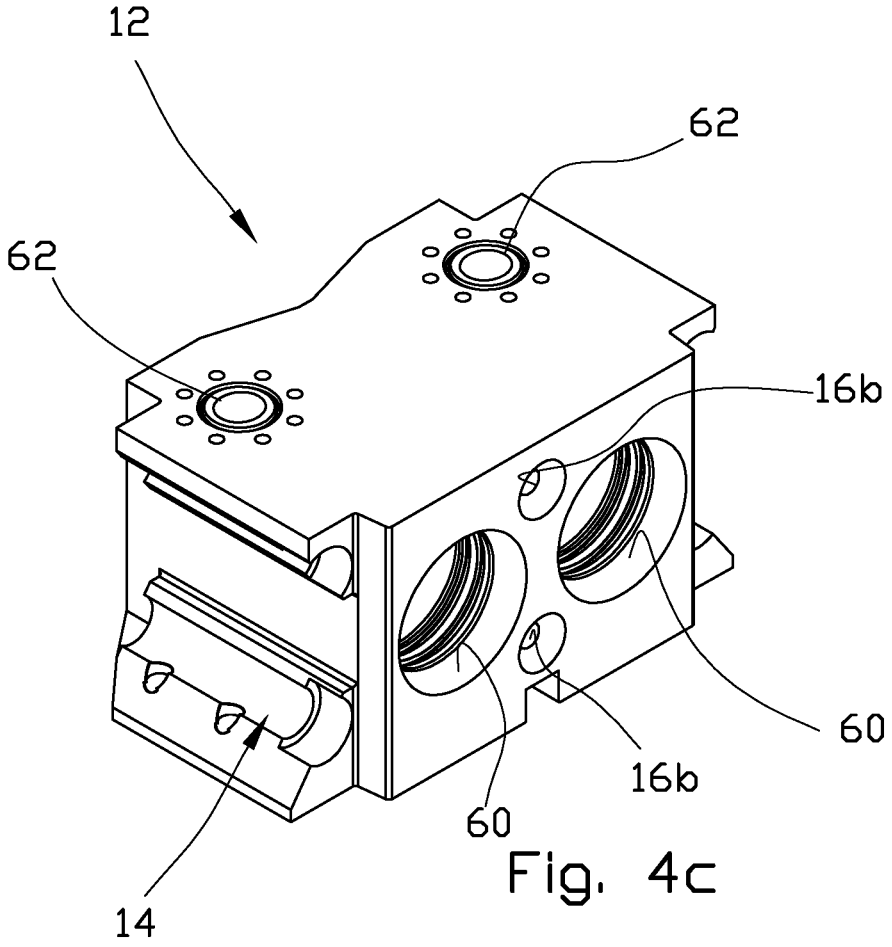
FIGS. 4*c* and 4*d* illustrate a perspective view of a receptacle block seen form a front and back, respectively.
Figure 4D:
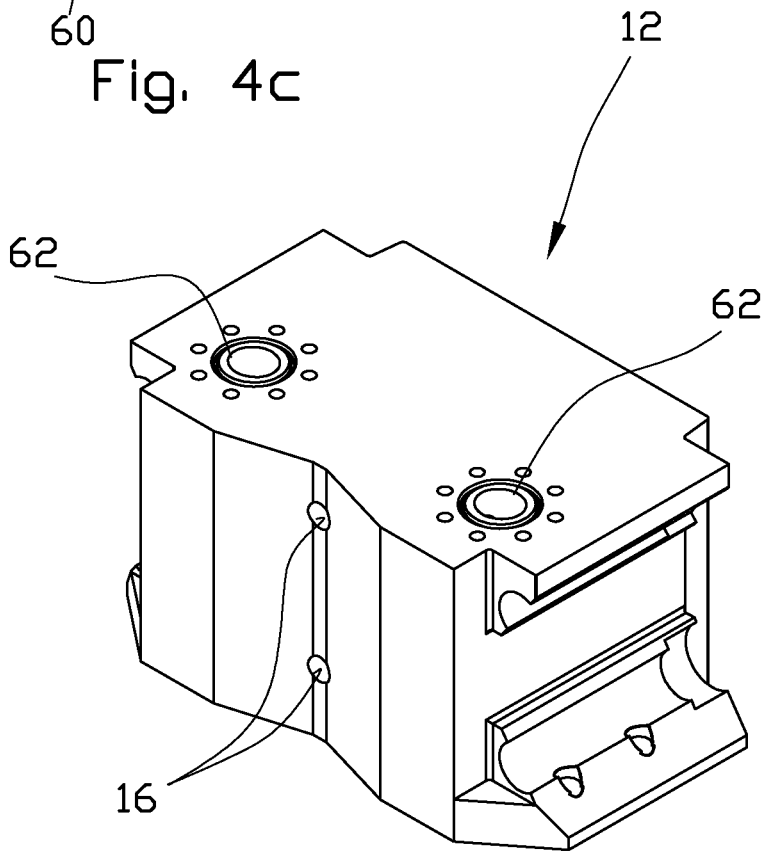

The receptacle block 12 is further provided with clearance holes 16 (two indicated in FIG. 4*d*).

An outer end portion of each of the clearance holes 16 is provided with a threaded portion 16*b*, see FIGS. 4*a* and 4*c*, for engaging pulling bolts. Pulling bolts are not shown in FIG. 4*a*. In FIG. 1*b*, the bolts indicated are sealing bolts 16*c* for preventing intrusion of contaminants into the clearance holes when the riser manifold 1 is in operation.

Prior to removing the receptacle block 12 from the housing 10, the sealing bolts 16*c* are removed and replaced by pulling bolts. Each pulling bolt has an axial length exceeding the axial length of the clearance hole 16. Thereby the pulling bolt may extend beyond an inner end face of the receptacle block 12 and abut against a pipe portion of the housing 10. By rotating the pulling bolt, the receptacle block 12 will be urged a distance out of the housing 10. A controlled and safe sliding of the receptacle block 12 may therefore be achieved. It should be noted that the pulling of the receptacle block 12 may alternatively be provided by pulling only but represents a less controllable pulling operation.

FIGS. 4*c* and 4*d* shows a perspective view of the fluid channel receptacle block 12 seen form a front and back, respectively. The receptacle block 12 further comprises channels 62 for connection to so-called RCD bleed valves (RCD—Rotating Control Device) as indicated in FIG. 1*a*. The channels 62 are in fluid communication with the flow channels 60.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A stabbing manifold for use in a system for Managed Pressure Drilling, MPD, the stabbing manifold configured for connecting to a riser manifold, the stabbing manifold being movable with respect to the riser manifold, the stabbing manifold comprising:

a fluid channel configured for communicating a well control fluid and for connection to both a fluid channel of the riser manifold and to a well control fluid return conduit, a plurality of control lines terminating in connectors configured for connecting to a plurality of connectors forming terminations of control lines of the riser manifold, wherein the connectors of the stabbing manifold are secured to a rigid holding means forming part of the stabbing manifold, the rigid holding means of the stabbing manifold being configured for a limited movement with respect to the stabbing manifold, a first alignment means configured for rough alignment with an alignment means of the riser manifold, a second alignment means forming part of the rigid holding means and configured for aligning with a rigid holding means of the riser manifold, wherein the rigid holding means of the stabbing manifold is movable in a plane perpendicular to a longitudinal axis of the first alignment means, and wherein the stabbing manifold further comprises one umbilical connection positioned opposite the connection between the fluid channel and the well control fluid return conduit, the umbilical connection for receiving an umbilical comprising control lines configured for communicating with the control lines of the stabbing manifold when the umbilical is connected to the stabbing manifold.

2. The stabbing manifold according to claim 1, wherein the connectors of the stabbing manifold are configured for a limited individual movement.

3. The stabbing manifold according to claim 1, wherein the control lines are selected from a group consisting of one of or a combination of two or more of electrical lines, hydraulic lines, pneumatic lines and fiber optic lines.

4. The stabbing manifold according to claim 1, wherein the well control fluid is a drilling mud for use in Managed Pressure Drilling, MPD.

5. A connection device for use in a system for Managed Pressure Drilling, MPD, the connection device comprising:

a riser manifold and a stabbing manifold movable with respect to the riser manifold, the connection device configured for connecting a plurality of control lines terminating in connectors forming part of the riser manifold, to corresponding control lines terminating in connectors forming part of the stabbing manifold, the connection device being provided with a first alignment means for rough alignment of the riser manifold and the stabbing manifold with respect to each other, wherein the connectors of the riser manifold are secured to a rigid holding means forming part of the riser manifold, and the connectors of the stabbing manifold are secured to a rigid holding means forming part of the stabbing manifold, at least one of the rigid holding means is configured for a limited movement with respect to the respective riser manifold and stabbing manifold, the connection device further comprising a second alignment means forming part of the rigid holding means and configured for aligning the rigid holding means with respect to each other, wherein at least one of the rigid holding means movable in a plane perpendicular to a longitudinal axis of the first alignment means, and wherein the riser manifold comprises a fluid channel for connection to a fluid channel of the stabbing manifold, the fluid channels being configured for communicating a well control fluid, wherein the riser manifold comprises a housing and a fluid channel receptacle block releasably secured to the housing, and wherein the fluid channel receptacle block is provided with at least one clearance hole running through the fluid channel receptacle block from a face thereof, the clearance hole provided with a threaded portion configured for receiving a pulling bolt.

6. The connection device according to claim 5, wherein the connectors of at least one of the riser manifold and the stabbing manifold are configured for a limited individual movement.

7. The connection device according to claim 5, wherein the connectors of one of the riser manifold and the stabbing manifold are prevented from individual movement, and the connectors of the other one of the stabbing manifold and the riser manifold are configured for the limited individual movement.

8. The connection device according to claim 5, wherein the control lines are selected from a group consisting of one of or a combination of two or more of electrical lines, hydraulic lines, pneumatic lines and fiber optic lines.

9. The connection device according to claim 5, wherein the well control fluid is a drilling mud for use in Managed Pressure Drilling, MPD.

10. The connection device according to claim 5, wherein the riser manifold forms part of a flow spool configured for use in Managed Pressure Drilling, wherein the control lines of the riser manifold is operatively connected to flow spool control means.

11. The connection device according to claim 10, wherein the stabbing manifold is configured for carrying mud return conduits for connection to the flow spool via the riser manifold.

12. The connection device according to claim 11, wherein the stabbing manifold is further provided with one umbilical connection for receiving an umbilical comprising control lines configured for communicating with the control lines of the stabbing manifold when the umbilical is connected to the stabbing manifold.

13. The connection device according to claim 5, wherein the fluid channel receptacle block is secured to the housing by fastening means con-figured for providing a clearance between the fluid channel receptacle block and the housing when in a position of use.

14. The connection device according to claim 13, wherein the fastening means are in the form of bolts and mating guiding sleeves.

15. The connection device according to claim 5, wherein the pulling bolt has an axial length exceeding an axial length of the clearance hole, so that the pulling bolt upon rotation may abut a surface of the housing beyond an end portion of the clearance hole and thereby displace the fluid channel receptacle block with respect to the housing.

* * * * *